US010436392B2

(12) United States Patent
Cao et al.

(10) Patent No.: US 10,436,392 B2
(45) Date of Patent: Oct. 8, 2019

(54) LED FILAMENT LIGHT

(71) Applicant: Leedarson Lighting Co., Ltd., Zhangzhou, Fujian (CN)

(72) Inventors: Liangliang Cao, Fujian (CN); Xiaobo Chen, Fujian (CN); Qiyuan Wang, Fujian (CN); Minghao Wu, Fujian (CN); Yunnan Lin, Fujian (CN); Fuwen Li, Fujian (CN)

(73) Assignee: LEEDARSON LIGHTING CO., LTD., Zhangzhou, Fujian (CN)

( * ) Notice: Subject to any disclaimer, the term of this patent is extended or adjusted under 35 U.S.C. 154(b) by 0 days.

(21) Appl. No.: 15/835,244

(22) Filed: Dec. 7, 2017

(65) Prior Publication Data

US 2019/0032858 A1 Jan. 31, 2019

(30) Foreign Application Priority Data

Jul. 31, 2017 (CN) ..... 2017 1 0639316

(51) Int. Cl.

| | |
|---|---|
| ***F21K 9/232*** | (2016.01) |
| ***F21K 9/238*** | (2016.01) |
| ***F21K 9/235*** | (2016.01) |
| ***F21V 23/00*** | (2015.01) |
| *F21Y 115/10* | (2016.01) |

(52) U.S. Cl.

CPC ..... *F21K 9/232* (2016.08); *F21K 9/235* (2016.08); *F21K 9/238* (2016.08); *F21V 23/001* (2013.01); *F21Y 2115/10* (2016.08)

(58) Field of Classification Search

CPC ..... F21K 9/232; F21K 9/238; F21K 9/235; F21V 19/003; F21V 23/001; F21Y 2115/10

USPC ..... 362/249.02

See application file for complete search history.

(56) References Cited

U.S. PATENT DOCUMENTS

2016/0356461 A1* 12/2016 Lai ..... F21V 19/003
2016/0369949 A1* 12/2016 Wu ..... H05B 35/00
2018/0080611 A1* 3/2018 Haberkorn ..... F21K 9/232

FOREIGN PATENT DOCUMENTS

DE 102016117450 A1 * 3/2018 ..... F21K 9/238

OTHER PUBLICATIONS

Frye et al., DE 102016117450 A1, Sep. 16, 2016, English language machine translation.*

* cited by examiner

*Primary Examiner* — Daniel A Hess

(74) *Attorney, Agent, or Firm* — Chun-Ming Shih; LanWay IPR Services

(57) ABSTRACT

A LED filament light has a bulb shell, a base portion, a filament module, a top spreading structure, a bottom spreading structure, a lamp cap and a driving piece. The filament module is placed in the containing space formed by the bulb shell and base portion. The filament module is composed of a plurality of filaments. The top of the plurality of filaments connects to the top spreading structure. The bottom spreading structure extends from the base portion, the bottom of the plurality of filaments connect to the bottom spreading structure. The top spreading structure is supported only by the plurality of filaments. The driving piece is placed in the lamp cap to provide electric power required for the plurality of filaments.

12 Claims, 17 Drawing Sheets

LED FILAMENT LIGHT

FIELD OF THE INVENTION

The present invention relates to a lighting device, and more particularly to a LED filament light with a plurality of filaments.

BACKGROUND OF THE INVENTION

As the development of the Light Emitting Diode (LED) technology in recent years, the lighting industry has changed a lot. More and more LEDs have been applied to lighting devices, especially to filament light. However, the LED light can't light-round as the Tungsten wire. The light emitted from LED have strong directivity. At present the LED filament light always light uneven, and it is easy to generate a dark spot at a portion of one end of the bulb shell due to less light. What's more, because of the strong directivity, the LED filament light always light with small angle, which can't meet the lighting requirements.

Therefore, how to design a LED filament light with uniform lighting effect and big lighting angle is the most urgent technical problem to be solved.

SUMMARY OF THE INVENTION

The first embodiment of the present invention provides a LED filament light. The LED filament light includes a bulb shell, a base portion, a filament module, a top spreading structure, a bottom spreading structure, a lamp cap and a driving piece.

The base portion is connected to the bulb shell and forming a containing space. The base portion have a closed air inlet. When fabricating, a thermal conductivity gas enters the containing space from the air inlet and the thermal conductivity gas is maintained within the containing space after the air inlet is closed. For example, the desired shape of the base portion can be made by melting the glass and placing it into a mold. When fabricating, keeping an air inlet. Burning the inlet after the containing space is filled with thermal conductivity gas, such as helium. Closing the air inlet when the burner is cooled, so that the thermal conductivity gas reminded in the containing space.

The filament module is placed in the containing space. The filament module is composed of a plurality of filaments, and there are electrical connectors at the top and the bottom of each filament, each filament houses a plurality of LED chips. The main lighting direction of each of the plurality of filaments is not exactly the same. For example, by placing the filaments along different directions to make the main lighting directions of these filaments oriented in different directions.

The top of the plurality of filaments is fixed to the top spreading structure. In addition, the bottom spreading structure may be fixed to the base portion and extend from the base portion. And the bottom of the plurality of filaments is fixed to the bottom spreading structure. The top spreading structure provides a horizontal space expansion such that the top of the filament connected to the top spreading structure forms a polygon with respect to each other. The bottom spreading structure provides a horizontal space expansion such that the bottom of the filament connected to the bottom spreading structure forms another polygon with respect to each other.

The top spreading structure is supported only by the plurality of filaments. In other words, from the bottom or the bottom structure, the top spreading structure may be supported without additional core stem or other addition structures. The top spreading structure is supported by the plurality of filaments, the plurality of filaments is further supported by the bottom spreading structure. The lamp cap may be a variety of Edison lamp caps connected to the base portion. In addition to connecting the lamp cap to the corresponding lamp holder to receive the power supply from the external power source, the lamp cap may have other different shapes in other embodiments.

The lamp cap may not connect to the base portion. For example, the base portion is made of glass material, same as the bulb shell, the bottom of the bulb shell and the circumference of the base portion are sintered with each other, and the bottom of the bulb shell can be bonded to the lamp cap by glue. The base portion and the bulb shell are sintered together to form a closed gas containing space.

The driving piece is placed in the lamp cap and is electrically connected to the filament module to provide electric power required for the plurality of filaments to illuminate.

In one embodiment, the top spreading structure may be a polygonal structure, the top of the plurality of filaments being fixed to the sides of the polygonal structure. The polygonal structure may be made of a metal material or a composite material or a transparent material, and the middle of the polygonal structure may be kept hollow to facilitate the movement of light.

In another embodiment, the top spreading structure may comprise a body, and a plurality of top extension pieces extending from the body. The body may be made of glass or plastic. On the other hand, the plurality of extension pieces may be a conductive material such as a metal. For example, the extension piece may be metal strip and a portion of the metal strip may be embedded in the body of the glass or plastic and the other portion extend from the body for electrical connecting the top of the plurality of filaments.

In this embodiment, the body is non-conductive and the top extension piece is conductive, and the top extension piece and body can be taken as two elements. These two elements can be fixed together by embedding, bonding, etc.

The electrical connection mentioned here refers to, for the elements consist of a plurality of conductive materials, when one of them received power, another also would receive power by connecting, thus electrically connected with each other.

In one embodiment, the top extension piece has a folded portion, the top electrical connector of the filament being welded to the folded portion of the top extension piece. For example, the body is glass and the top extension piece is a metal strip. A part of the metal strip is embedded in the glass body and the extension part of the metal strip is bent. The top of the filament is fixed to the folded portion of the metal strip by means of glue or welding or attachment.

In one embodiment, the top spreading structure at least provides with one top conductive element, such that at least a portion of the top of the plurality of filaments connected to the top spreading structure to constitute an electrical connection.

For example, in the above example, the top extension piece may be partially embedded in the glass body and have two ends extending outwardly and connected to the top electrical connectors of the two filaments, respectively. Thus, the two filaments can be electrically connected. A plurality of LED chips is set inside of the filaments, and then set a strip-like or board-like electrical connector at the two ends. By connecting the electrical connectors of two sides of the filament directly or indirectly, it can be combined into a variety of required parallel or series combinations. The parallel or series combinations mentioned herein may refer to situations in which pure parallel, pure series, or partially parallel and partially series.

In one embodiment, the bottom spreading structure at least provides with two bottom conductive elements, and the electrical connection between the filaments or the electrical connection with the drive circuit is accomplished by the bottom conductive element.

For another example, the top spreading structure itself may be a polygonal metal piece. When the top electrical connectors of all the filaments are welded to the metal pieces, the desired electrical connection is created between these filaments. In other words, in some embodiments, the top conductive element may electrically connect all electrical connectors which are connected to the top of the filaments of the top spreading structure.

In another embodiment, the top spreading structure provides with two or more separated top conductive elements. The plurality of filaments is divided into two or more groups, and the top electrical connectors in the same group are electrically connected through the top conductive elements, the top electrical connectors in different groups are not directly electrically connected. For example, it is assumed that the tops of the six filaments are connected to the top spreading structure and there are three separate top conductive elements. When the two filaments in the same group are connected to a top conductive element, there are three sets of separate electrical connections. With the electrical connection arrangement of the bottom spreading structure, a variety of different parallel or series electrical connection combinations can be set to meet the required lighting requirements.

In another aspect, the bottom spreading structure has at least one bottom conductive element, so at least a portion of the bottom of the plurality of filaments connect to the bottom spreading structure to constitute an electrical connection.

In one embodiment, the bottom conductive element may electrically connect all electrical connectors which are connected to the bottom of the filaments of the bottom spreading structure. In other embodiments, the bottom spreading structure provides with two or more separate bottom conductive elements. The plurality of filaments is divided into two or more groups, and the bottom electrical connectors in the same group are electrically connected through the bottom conductive elements, the bottom electrical connectors in different groups are not directly electrically connected.

The relevant description can refer to the description of the top spreading structure, which is not repeated here.

In addition, in one embodiment, the horizontal area of the top spreading structure is less than the horizontal area of the bottom spreading structure so that the plurality of filaments are arranged in a cone shape with wide bottom and narrow top. In other words, the cone shape with wide bottom and narrow top, constituted by the plurality of filaments, is a twisted cone shape. For example, the top spreading structure is in a hexagonal shape, and the bottom spreading structure is also in a hexagonal shape, but the two are shifted in a relative angle, so that the plurality of filaments is distributed in twisted and interlocked.

In one embodiment, the bottom spreading structure may be secured to the base portion. In particular, the base may provide with a first assembly structure, corresponding to a second assembly structure of the bottom spreading structure. The first assembly structure of the base portion and the second assembled structure of the bottom spreading structure may be joined in various ways such that the bottom spreading structure is fixed to the base portion.

For example, the first assembly structure is a protruding column, the second assembly structure is a corresponding groove, or a reverse design. The first assembly structure and the second assembly structure may be fixedly connected together by hot melting and cooling. This method can be applied at least to glass-to-metal or glass-to-glass bonding. And, this combination of hot melting, can bring better heat dissipation.

In addition, in some embodiments, the base portion may provide with two first assembly structures, the first assembly structure being a wire structure. One end of the first assembly structure is electrically connected to a power supply element which is provided outside the base portion, and the other end of the first assembly structure is protruded over the base portion after through the base portion, the two bottom conductive elements are welded to the other end of the two first assembly structures, respectively, to secure to the base portion. This approach can simplify the manufacturing process, reduce costs and increase the stability of the product.

In addition, in some embodiments, the bottom conductive element may be a rigid closed loop structure, the bottom conductive element having a greater cross-sectional area than the first assembly structure.

In one embodiment, the bottom spreading structure may be electrically connected to the driving piece, transmitting the power generated by the driving piece to the plurality of filaments for illumination. For example, the bottom spreading structure includes wires corresponding to the positive and negative electrodes respectively, and transmitting the current of the driving piece to the series or parallel filaments.

The other embodiment of the present invention provides a method of fabricating a LED filament light, including the following steps.

Fix the filament module to the top spreading structure, the filament module is composed of a plurality of filaments, and each filament is set a plurality of LED chips.

Fix the bottom spreading structure to the base portion.

Fix the filament module to the bottom spreading structure. The bottom of the plurality of filaments is fixed to the bottom spreading structure. The top spreading structure is supported only by the plurality of filaments.

Install the bulb shell to make the bulb shell connect to the base portion to form a containing space.

Fill the thermal conductivity gas in the containing space from the air inlet of the base portion.

In one embodiment, some of the top spreading structure and the bottom spreading structure have a top conductive element and a bottom conductive element respectively. The top conductive element and a bottom conductive element are used for electrically connecting to the plurality of filaments which is fixed to the top spreading structure and the bottom spreading structure.

The beneficial effect of the present invention is that the light from LED filament light may be uniform and with large lighting angles through the above-described technical solution.

DETAILED DESCRIPTION

Figure 1:
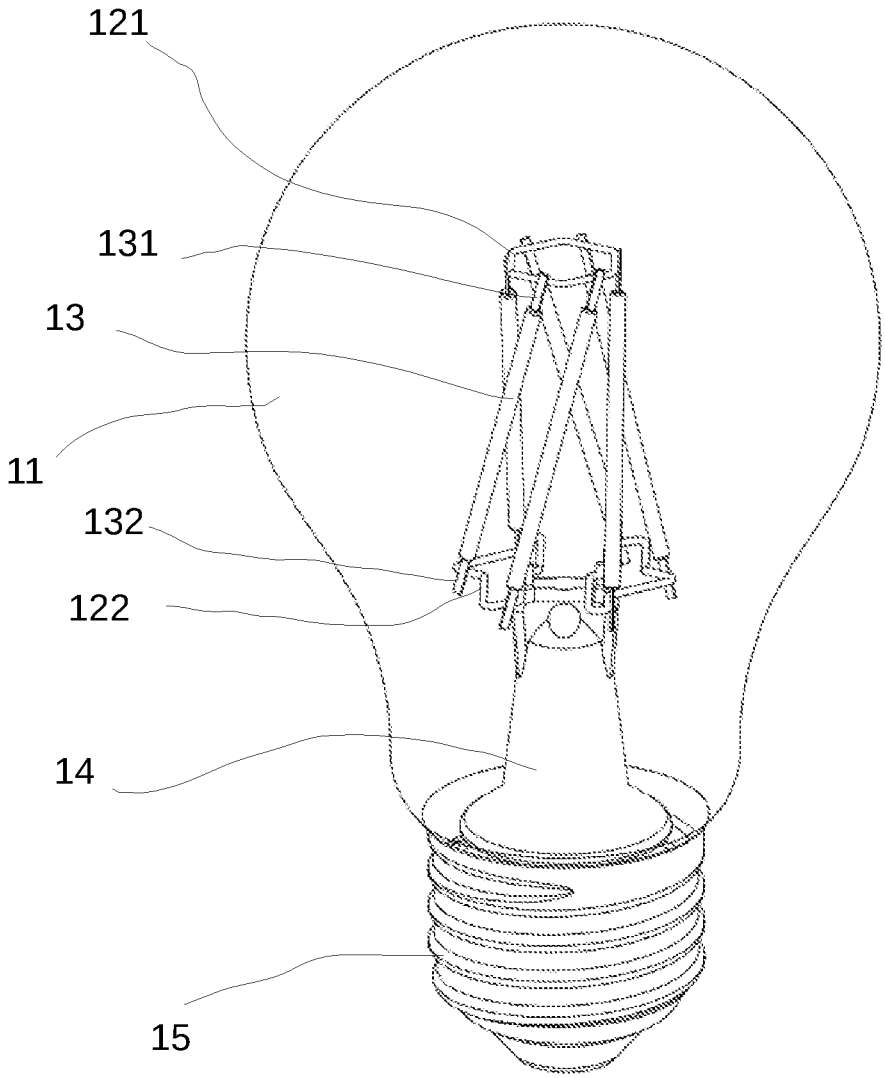
FIG. 1 illustrates a LED filament light.
Figure 2:
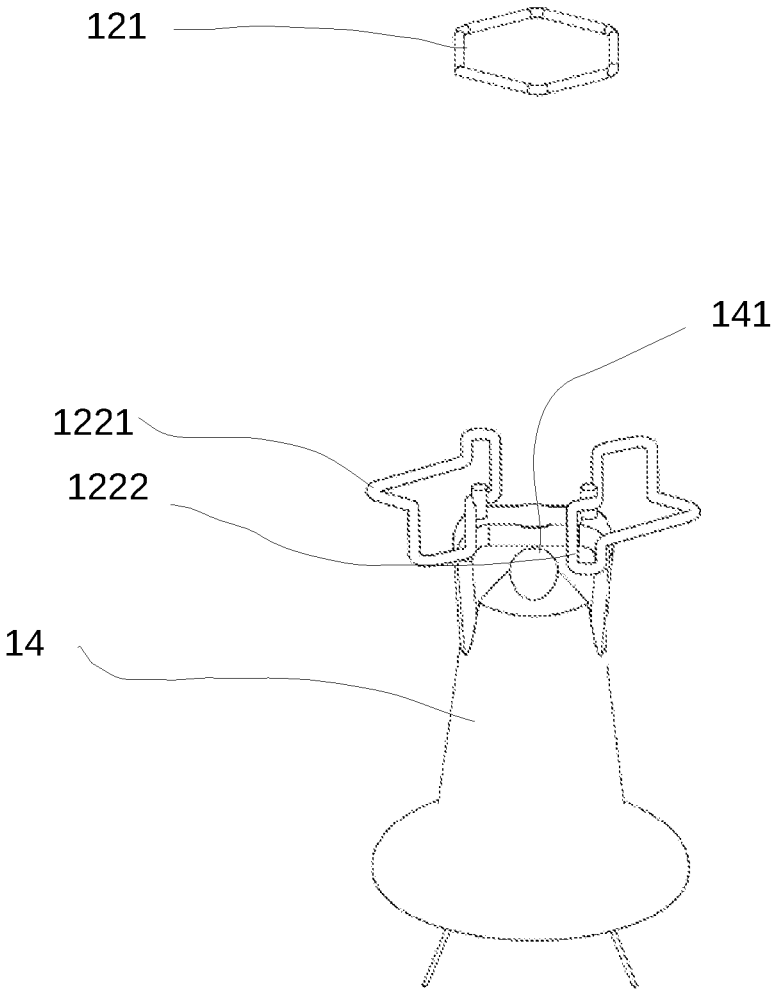
FIG. 2 illustrates a schematic of partial elements of FIG. 1.
Figure 3:
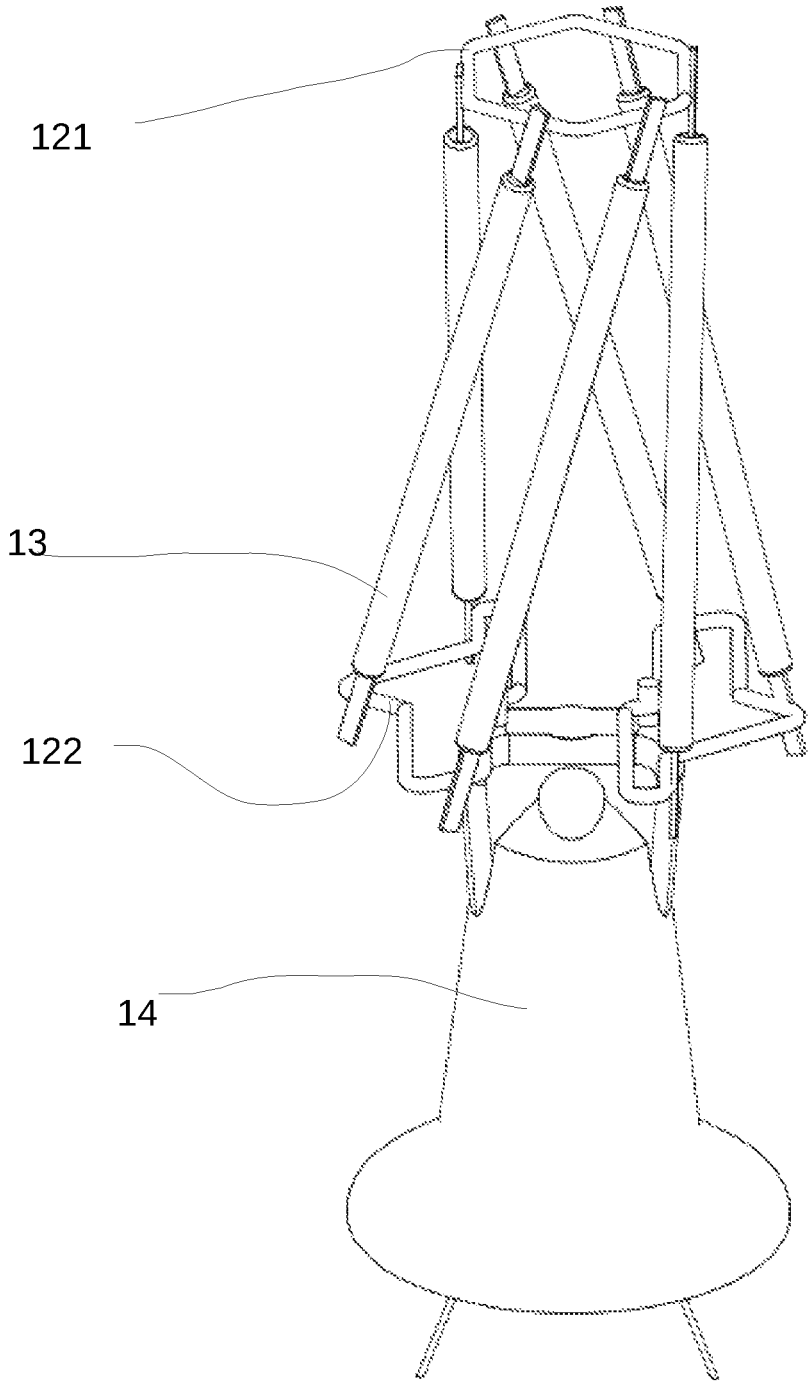
FIG. 3 illustrates a schematic of partial elements of FIG. 1.

Please refer to FIG. 1 to FIG. 3. FIG. 1 to FIG. 3 illustrate an example of a LED filament light according to present invention. FIG. 1 illustrates an example of a LED filament light. FIG. 2 illustrates the first schematic representation of some of the elements of FIG. 1. FIG. 3 illustrates the second schematic representation of some of the elements of FIG. 1.

A LED filament light comprises a bulb shell 11, a base portion 14, a filament module 13, a top spreading structure 121, a bottom spreading structure 122 and a lamp cap 15. In addition, a driving piece (not shown) is placed in the lamp cap 15; the driving piece is electrically connected to the filament module 13 to provide electric power required for the plurality of filaments to illuminate.

The base portion 14 is connected to the bulb shell 11 to form a containing space. The base portion 14 have a closed air inlet 141. When fabricating, a thermal conductivity gas enters the containing space from the air inlet 141 and be maintained in the containing space after the air inlet 141 is closed.

The filament module 13 is placed in the containing space. The filament module 13 is composed of a plurality of filaments, and there is an electrical connector at the top and the bottom of each filament, each filament houses a plurality of LED chips (not shown). The main lighting direction of each of the plurality of filaments is not exactly the same. The top 131 of the plurality of filaments is fixedly connected to the top spreading structure 121.

The bottom spreading structure 122 extends from the base portion 14, the bottom 132 of the plurality of filaments is fixedly connected to the bottom spreading structure. The top spreading structure 121 is supported only by the plurality of filaments. The lamp cap 15 is connected to the bottom the Bulb shell 11.

Figure 4:
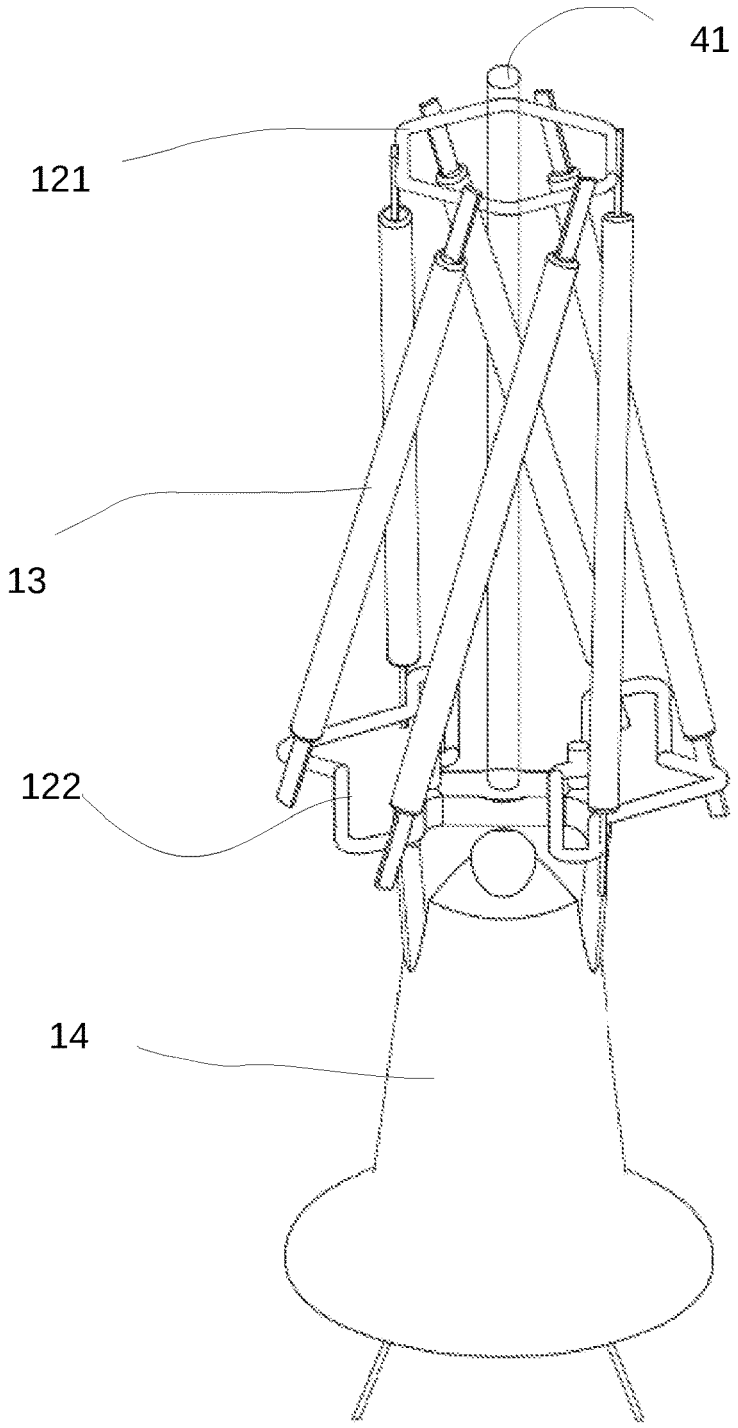
FIG. 4 illustrates a schematic of partial elements of another LED filament light.

Please further refer to FIG. 4. FIG. 4 illustrates a schematic diagram of partial element of another LED filament light. In the embodiment of FIG. 4, the same elements as those in FIG. 1 to FIG. 3 are denoted by the same reference numerals, and the description thereof will not be repeated here. With respect to FIG. 1 to FIG. 3, the embodiment of FIG. 4 further provides a supported core stem 41. The core stem 41 is not directly connected to the top spreading structure 121. However, when the entire filament module 13 is shaken, the care stem 41 can help to return stable. For example, when the filament of the filament module 13 is shaking by the handling process, the degree of shaking can be limited by the core stem 41. And, at the end of the shaking, the filament may return to a stable position and state. With this design, the stability of the LED filament light of this embodiment can be further enhanced.

In the embodiment of FIG. 1 to FIG. 4, the filament of the filament module is present in a three-dimensional relationship, it can improve the result of the light irradiation so that the light does not concentrate on the specific area.

Figure 5:
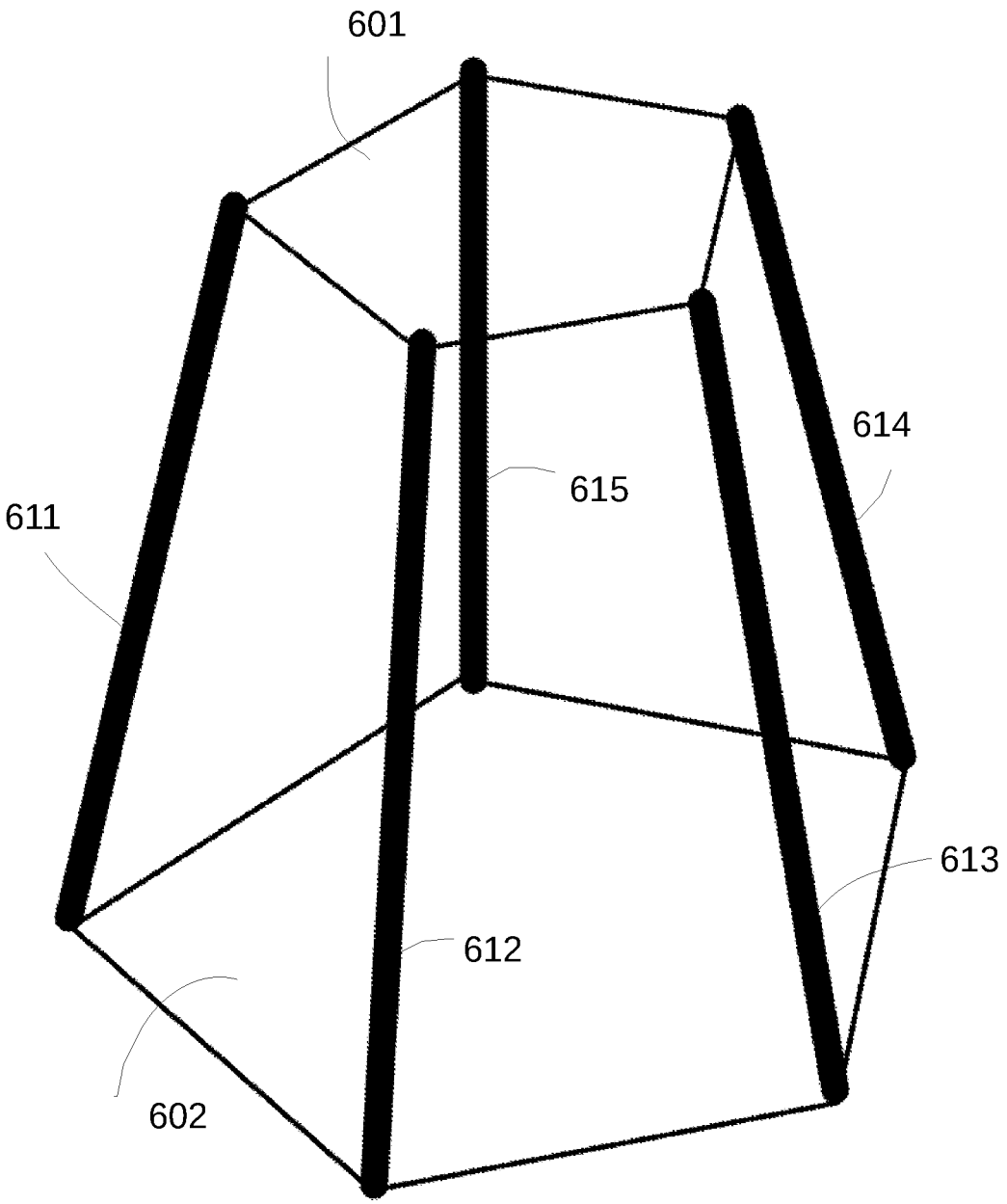
FIG. 5 illustrates a schematic of the three-dimensional relationship between the plurality of filaments.
Figure 6:
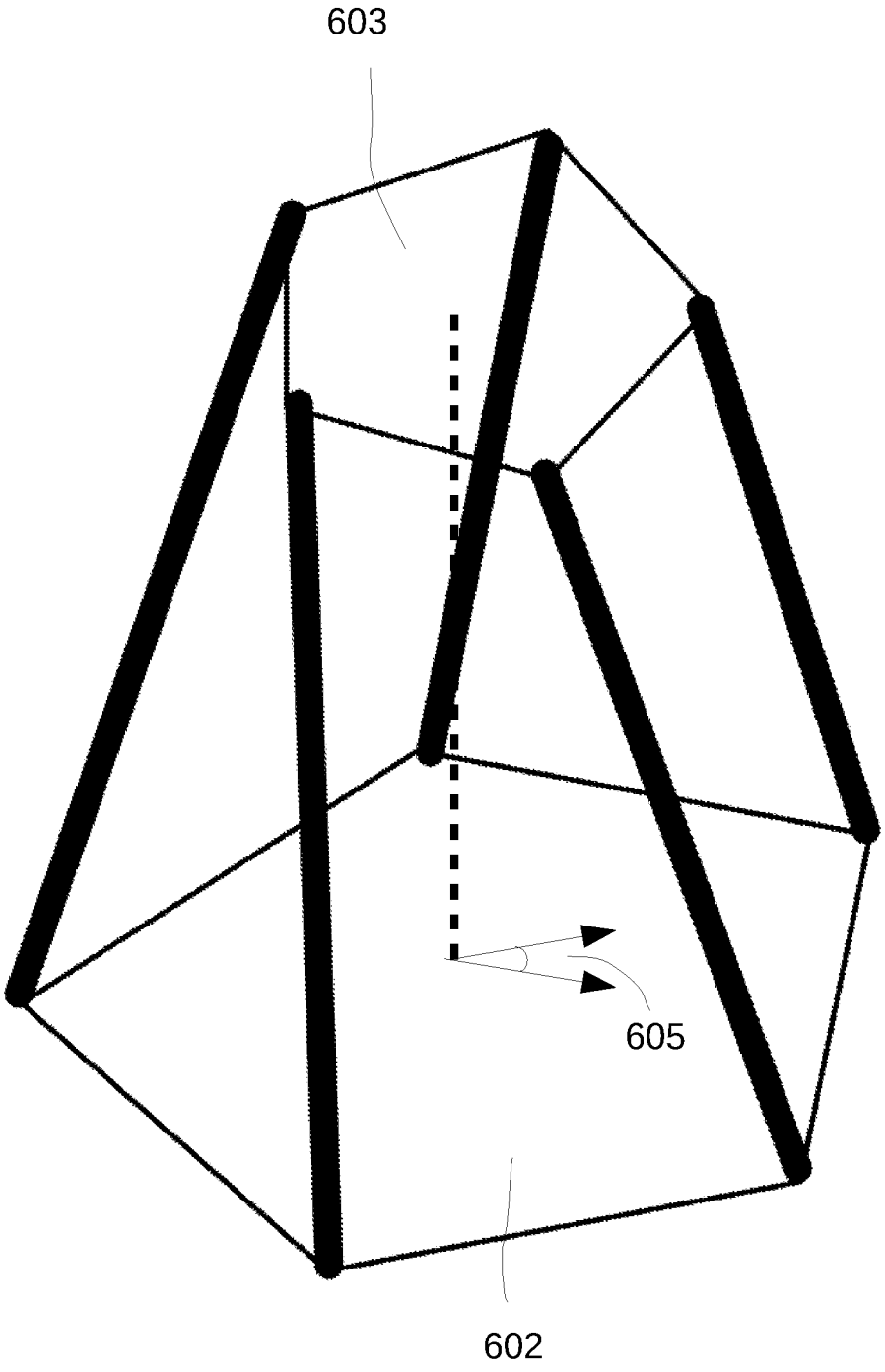
FIG. 6 illustrates a schematic of the three-dimensional relationship between the filaments which are relative twisted.

Please further refer to FIG. 5 and FIG. 6. FIG. 5 and FIG. 6 illustrates the position relationship and the configuration method between the filaments.

Here mentioned electrical connectors of one end or the other end of the filament is a conductor, which can be used to electrically connect with an external circuit element or power line in series to direct the appropriate current to the LED chip of the filament, making the LED chip light. The electrical connector of each filament can be set independently, but also can be integrated formed with an electrical connector of another filament. In other words, in the latter case, if you want to connect the two filaments in series, additional welding is not needed, as at least one end of the two lights have been connected in series Please refer to FIG. 5. FIG. 5 illustrates the relative relationship between the top polygon formed by one end of the filament and the bottom polygon formed by the other end of the filament. According to an embodiment, one end of the plurality of filaments 611, 612, 613, 614, 615 form a top polygon 601, and the other end of the plurality of filaments 611, 612, 613, 614, 615 form a bottom polygon 602; the area of the top polygon 601 is smaller than the area of the bottom polygon 602. In other words, one end of the plurality of filaments has a relatively small polygon, and the other end of the plurality of filaments has a relatively large polygon; forming a substantially polygonal cone with a wide bottom and a narrow top. This setting can offer a relatively desired lighting route.

According to another embodiment, the shape of the top polygon is substantially similar to the shape of the bottom polygonal, but the top polygon and the bottom polygonal are shifted by a predetermined angle. As described above, these filaments 611, 612, 613, 614, 615 usually have different lighting directions. If these filaments are directly perpendicular to the surface of the bulb shell, it is easy to produce a partial area which is particularly bright and a partial area which is relatively dark, generating light spots. Such a problem is particularly noticeable when the bulb shell is not completely transparent, such as the bulb shell is milky white. It has been experimentally found that if the top polygon 601 of the plurality of filaments is shifted from the bottom polygon 602 by an angle 605, a more desirable lighting effect can be obtained. For example, avoiding the light spots. In addition, the ideal shifted angle can be greater than 10 degrees, less than 80 degrees.

In other words, the horizontal area of the top spreading structure is less than the horizontal area of the bottom spreading structure so that the plurality of filaments are arranged in a cone shape with wide bottom and narrow top, as shown in FIG. 5. In addition, the top spreading structure and the bottom spreading structure are shifted in a relative angle, so that the plurality of filaments are distributed in twisted and interlocked, as shown in FIG. 6.

As described above, for the light spot problem, it is possible to make the regular light spot disappear by adjusting the main lighting direction of the plurality of filaments. Because of the different shape and size of the bulb shell, the length of the filament and the lighting angle might not the same. Hence, the best shifted angle can be ensured by atomizing the surface of the bulb shell and experimentally adjusting the main lighting direction of the plurality of filaments to minimize the adverse effects of the light spot. Through this way, the LED filament light can light uniform with large lighting angle.

In the application of LED chips, there will be a positive and a negative power input terminal.

In some embodiments, these filaments can be provided in series/parallel. Of course, the description here, in addition to the first group of filaments, a second set of filaments also can be allowed, and different designs can be designed base on different needs. For example, for the filaments with different directions, it can be arranged in different groups with relatively different parameters, to provide different lighting parameters, so that to produce the most effective lighting effects on the entire LED filament light.

In addition, if the angle of the filament can be further homogenized, that is, not only light at a specific angle, and the lighting effect of the entire LED filament light would be better, and at the same time, by such setting, the lighting angle of the device will be greatly increased. One approach is setting the filaments with more three-dimensional way. As described in the previously embodiments, the bottom cross-section of the translucent cover needs often to match with the size of the lamp cap. On the other hand, if the filament module need be placed in the translucent cover, as it is often limited by the bottom cross-section of the translucent cover, so it is not easy to put it into the transparent cover.

Thus, in one embodiment, some elastic elements can be added to the extension piece of the base portion, such as a shrapnel or spring, to make a certain compression to the bottom of the filament module when placing the filament module and base portion together into the bulb shell from the bottom of the bulb shell. After that, expanding the bottom of the filament module.

With this design, the polygonal area at the bottom of the filament module can be larger than the inlet area of the lamp cap. And, this design can make the lighting angle of the entire filament module more three-dimensional, but also can bring better lighting effect.

In addition, even with the same number of LED chips, a relatively longer filament can further uniform the light. In one embodiment, the height of the plurality of filaments in the direction of the lamp cap axis accounts for more than 50% of the height of the light bulb shell in the same direction so that a better lighting effect can be produced.

In addition, dark areas often appear at the top of the LED filament light. In order to solve such a problem, it is possible to place a denser LED chips in a region that the filament near the top of the translucent cover, i.e., the filament away from the bottom of the light translucent cover. Alternatively, one or more light sources may be installed on the expansion portion. For example, the expansion portion can be made into a module in which a substrate with a LED chip and an optical element are provided, the optical element can handle light more uniform, such as a diffuser plate. By mounting a light source on the expansion portion, the lighting strength toward the top of the light bulb shell can be enhanced.

As mentioned above, the filament module is mainly located above the base portion. In order to supply power, the driving piece under the base portion also needs to generate the required current. For the convenience of assembly, a connection socket can be installed in the base portion. For example, a latching device such as a shrapnel or spring may be provided. And on the other hand, two corresponding electrical connectors may be provided at the top of the driving piece, such as the driving circuit board. When assembling, the two electrical connecting wires can be inserted into the connection socket, eliminating time and cost of soldering. In another embodiment, the base portion may be provided with a protruding electrical connector, and the driving piece may be provided with an interface, or another different design.

In addition, it is also possible to set heat sinks connecting to the core stem on the base portion to achieve heat dissipation. The heat sinks may have various shapes. These heat sinks can be further connected to other heat sinks, such as the heat sinks inside the driving piece or lamp cap to enhance the heat dissipation effect. All of which should to be considered as falling within the scope of the present invention.

Figure 7:
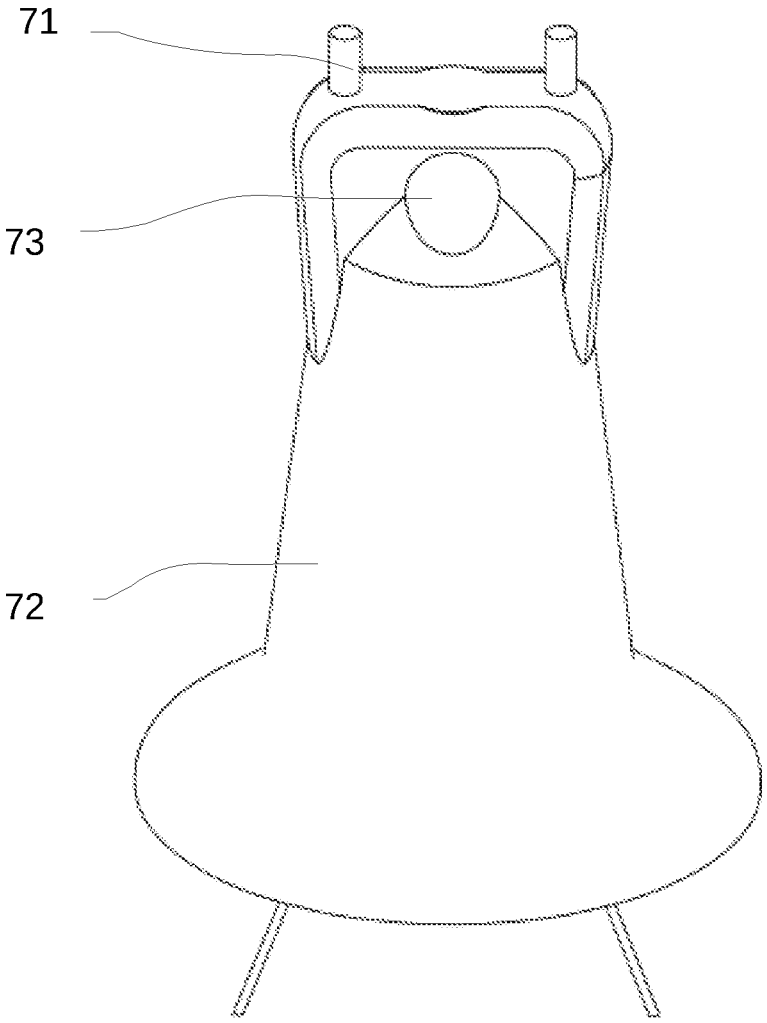
FIG. 7 illustrates a schematic of partial elements of FIG. 1.
Figure 8:
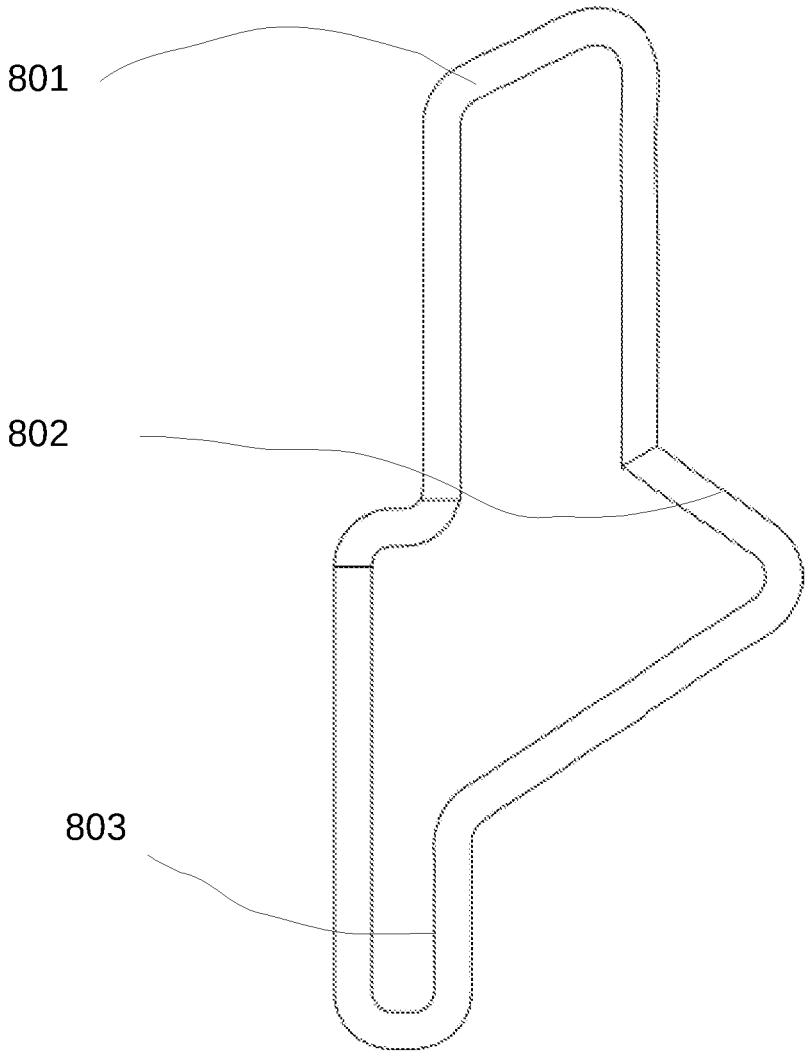
FIG. 8 illustrates a schematic of partial elements of the bottom spreading structure.

Please further refer to FIG. 7, in FIG. 7, the base portion 72 has an air inlet 73. In addition, the base portion 72 is provided with a first assembly structure 71. In this example, the first assembly structure 71 is a protruding short column. Of course, the first assembly structure 71 may also have other shapes as long as it can be used in combination with a second assembly structure of the bottom spreading structure.

Please further refer to FIG. 8, and FIG. 1 to FIG. 3. There are three filaments connected to the contacts 801,802,803 of the bottom of the structure. The bottom connection structure may be a metal piece, or a combination of two or more materials, including a combination of insulators and conductors, so that the filaments can be electrically connected in the desired way, in series or in parallel.

Figure 9:
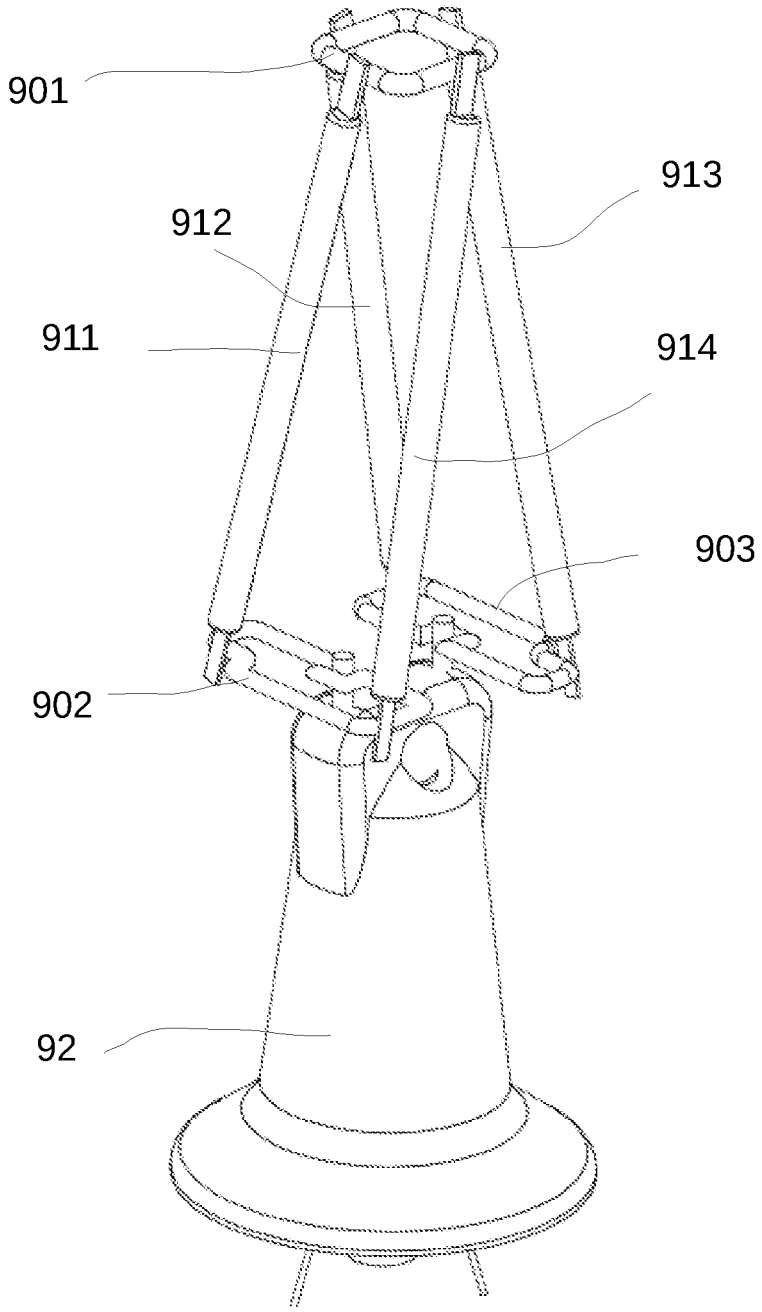
FIG. 9 illustrates a schematic of partial element of another LED filament light.
Figure 10:
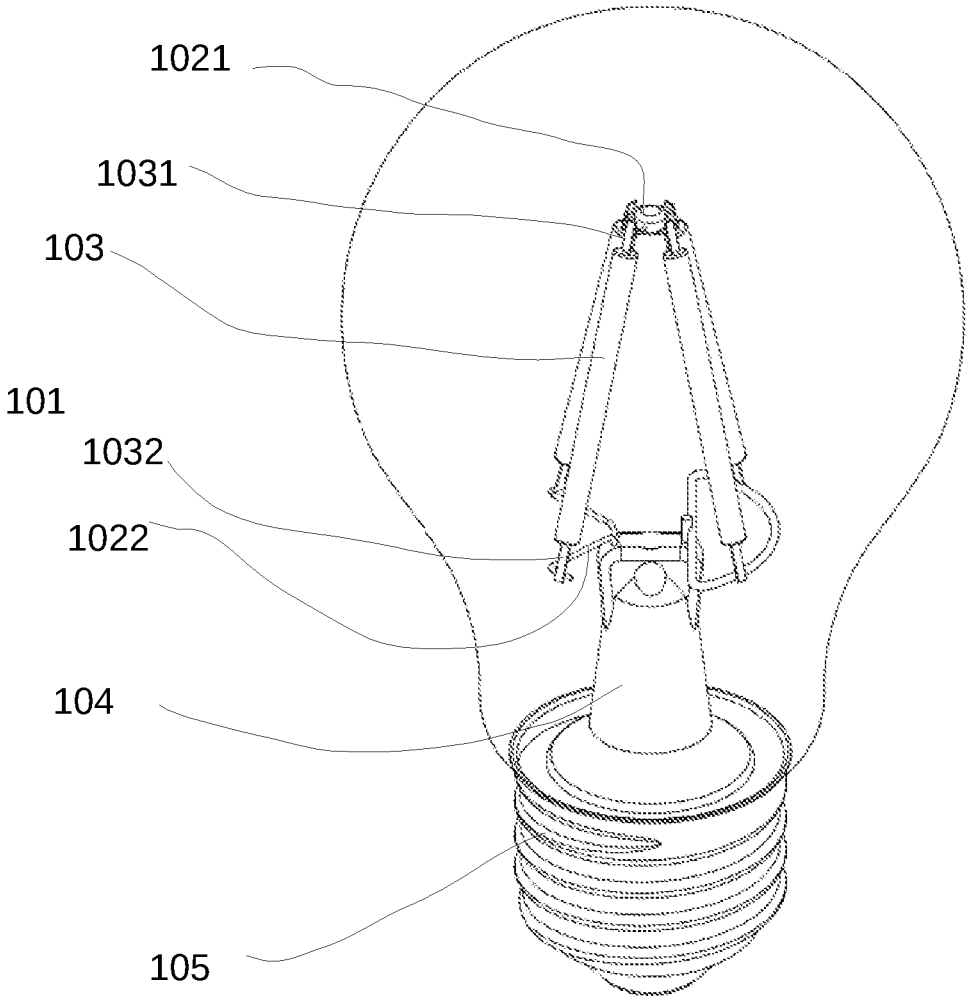
FIG. 10 illustrates another LED filament light.
Figure 11:
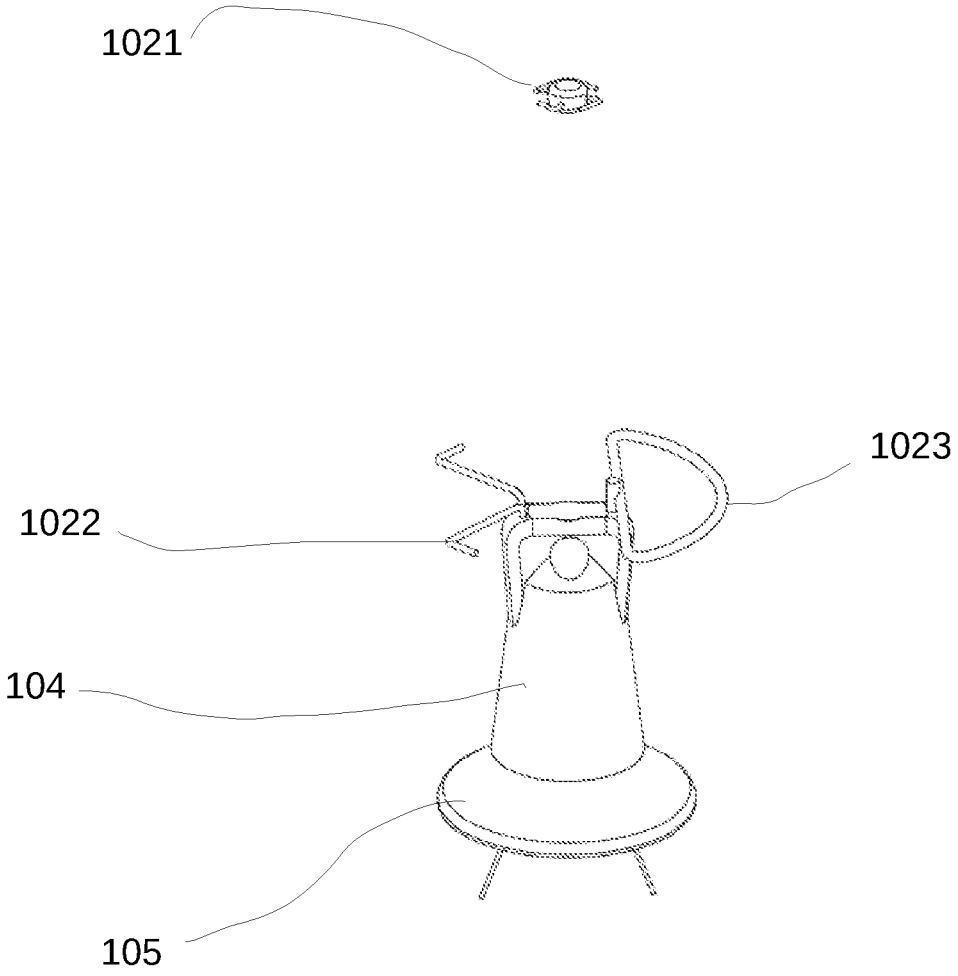
FIG. 11 illustrates a schematic of parts of the elements of FIG. 10.
Figure 12:
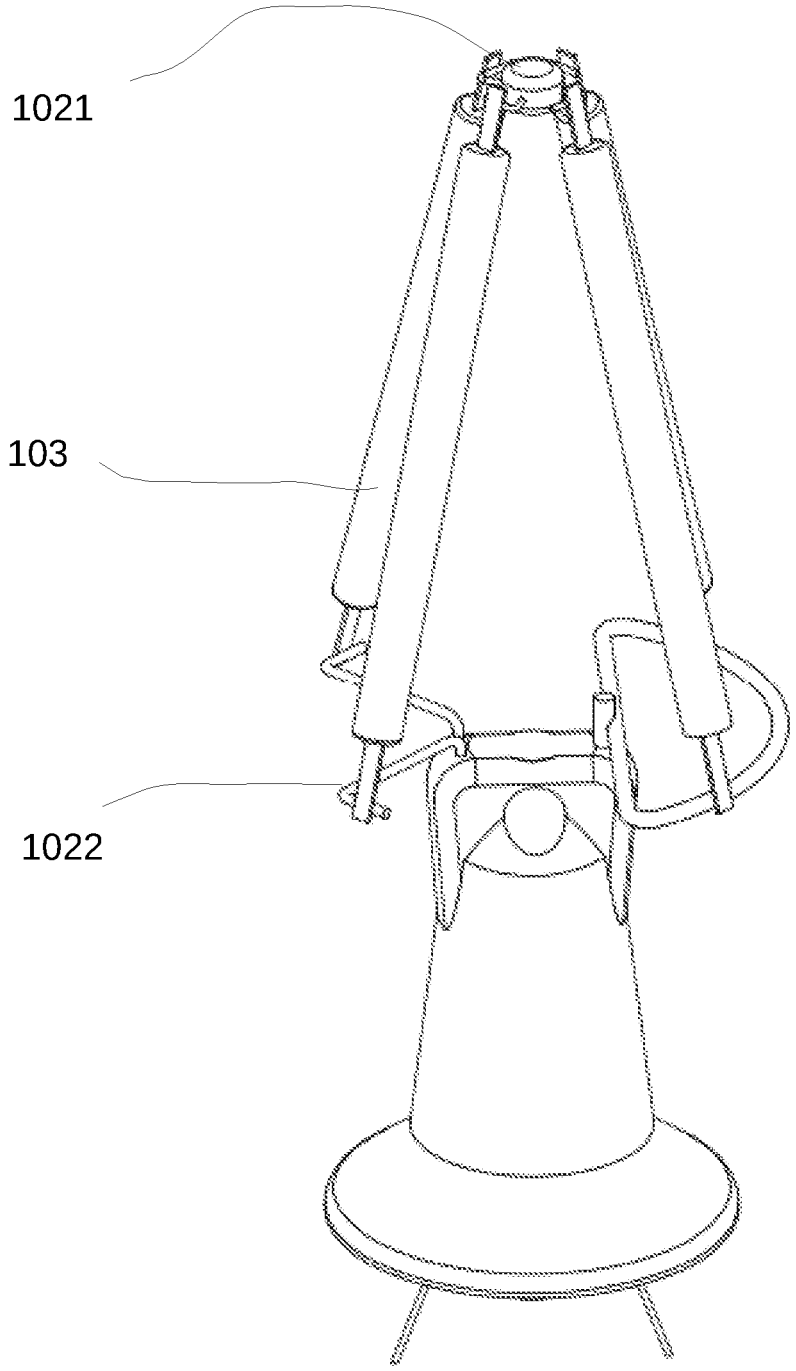
FIG. 12 illustrates a schematic of parts of the elements of FIG. 10.

Please further refer to FIG. 9. FIG. 9 illustrates another embodiment. In the embodiment shown in FIG. 1 to FIG. 3, the filament module 13 has six filaments. In contrast, in FIG. 9, there are four filaments 911, 912, 913, 914. The tops of the four filaments 911, 912, 913, 914 are joined by a top spreading structure 901. And the bottoms of the four filaments 911, 912, 913, 914 are joined by a bottom spreading structure 902. The bottom spreading structure 902 extends from the base portion 92.

Please further refer to FIG. 10 to FIG. 15. FIG. 10 to FIG. 15 illustrates another LED filament light embodiment. In this example, the top 1031 of the filament module 103 connect to the top spreading structure 1021. The bottom 1032 of the filament module 103 is coupled to the bottom spreading structure 1022. Similar to the previous embodiment, the top spreading structure 1021 is primarily supported by the filament module 103 and is not directly connected to the base portion 104.

Figure 14:
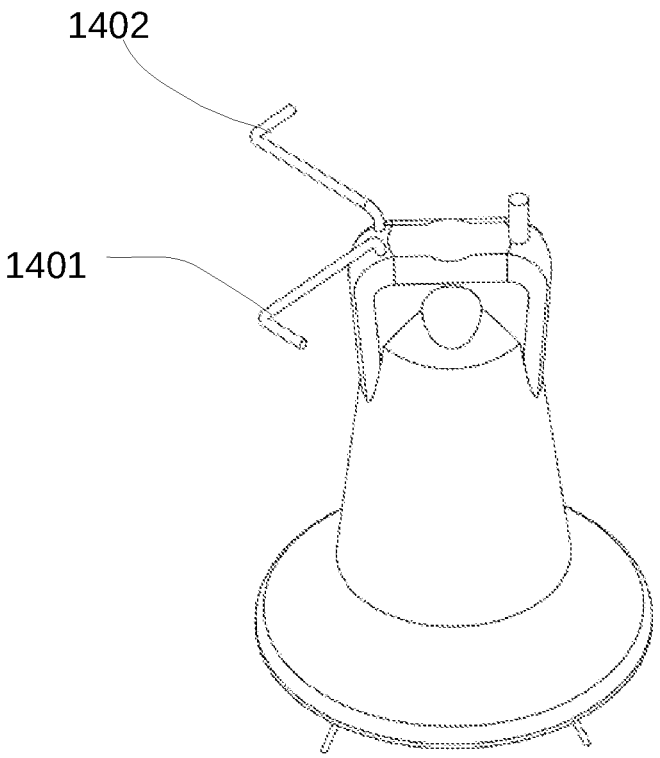
FIG. 14 illustrates a schematic of parts of the elements of FIG. 10.
Figure 15:
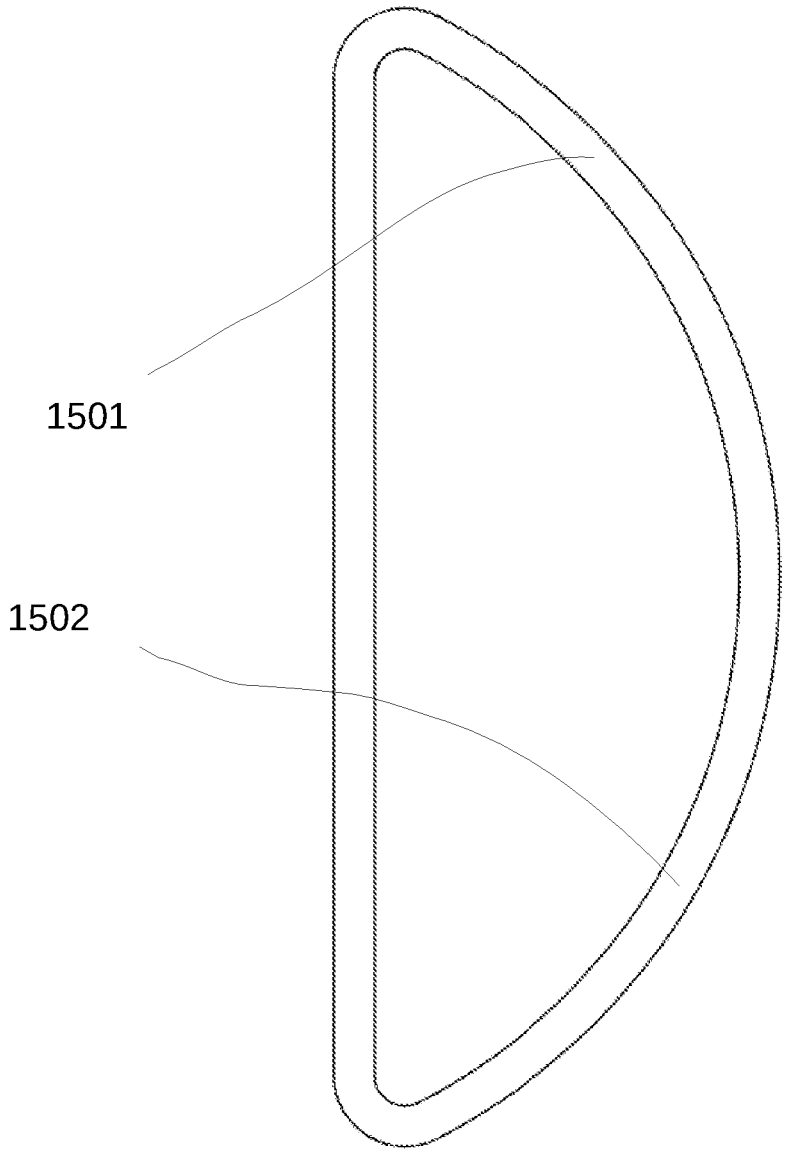
FIG. 15 illustrates a schematic of parts of the elements of FIG. 10.

As shown in FIG. 14, the bottom spreading structure has a positive and a negative electrical connection line 1401, 1402. Please refer to FIG. 11 and FIG. 12, the bottom spreading structure 1022 also has a D-shaped structure 1023 for adjusting the angle of the filament to the most suitable position to provide a better illumination angle and effect. In this embodiment, the bottom of the two filaments is connected to the contacts 1501, 1502 of the D-type structure 1023, as shown in FIG. 15.

Figure 13:
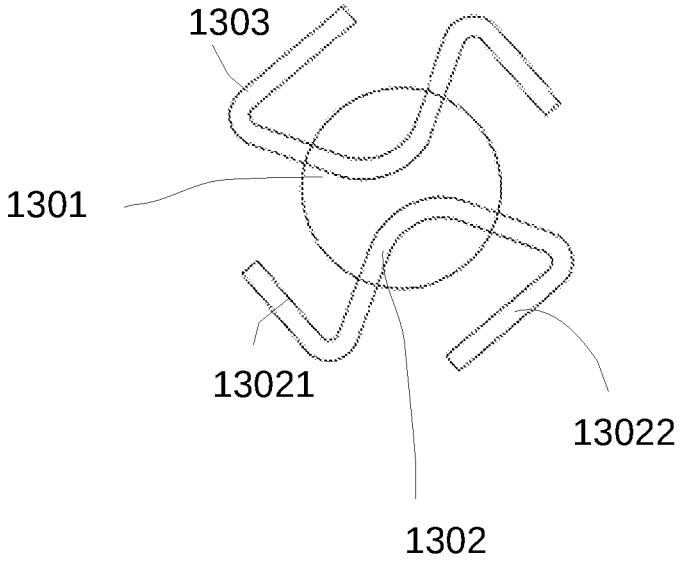
FIG. 13 illustrates a schematic of parts of the elements of FIG. 10.

As shown in FIG. 13, the top spreading structure has a body 1301, and two extension pieces 1302, 1303. Wherein the extension piece 1302 has a portion embedded in the body 1301, two additional extension pieces 13021, 13022 extend outwardly from the body 1301 with a bent portion. The top of the filament 103 connects the bent portions of the two extended pieces 13021, 13022 of the top spreading structure. The material of these extension pieces 1302, 1303 may contain a metal, having a certain electrical conductivity.

As described above, the top spreading structure may have a different shape, such as the middle hollow polygonal structure shown in FIG. 1 or another structure shown in FIG. 13. The top spreading structure may also be designed as other regular or irregular shapes as long as the tops of the plurality of filaments are fixedly connected to the sides of the polygonal structure.

The top spreading structure may be made of metal or a metal with a variety of insulating materials so that the filament module can be connected in a predetermined manner, in series or in parallel.

The top spreading structure at least provides with one top conductive element, such that at least a portion of the top of the plurality of filaments connected to the top spreading structure to constitute an electrical connection. For example, in one embodiment, the top conductive element electrically connects all electrical connectors which are connected to the top of the filaments of the top spreading structure. In another embodiment, the top spreading structure provides with two or more separate top conductive elements. The plurality of filaments is divided into two or more groups, and the top electrical connectors in the same group are electrically connected through the top conductive elements, the top electrical connectors in different groups are not directly electrically connected.

The bottom spreading structure can be similar to the top spreading structure which is not repeated here.

Figure 16A:
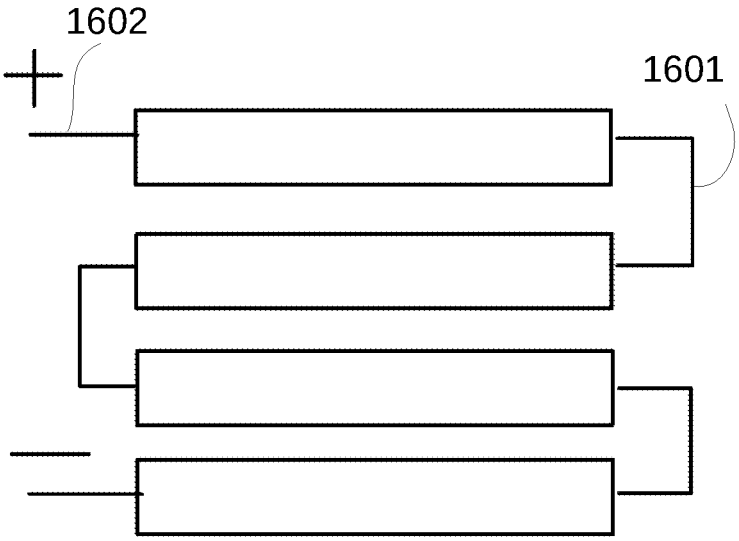
FIG. 16A illustrates a series/parallel arrangement of filaments.
Figure 16B:
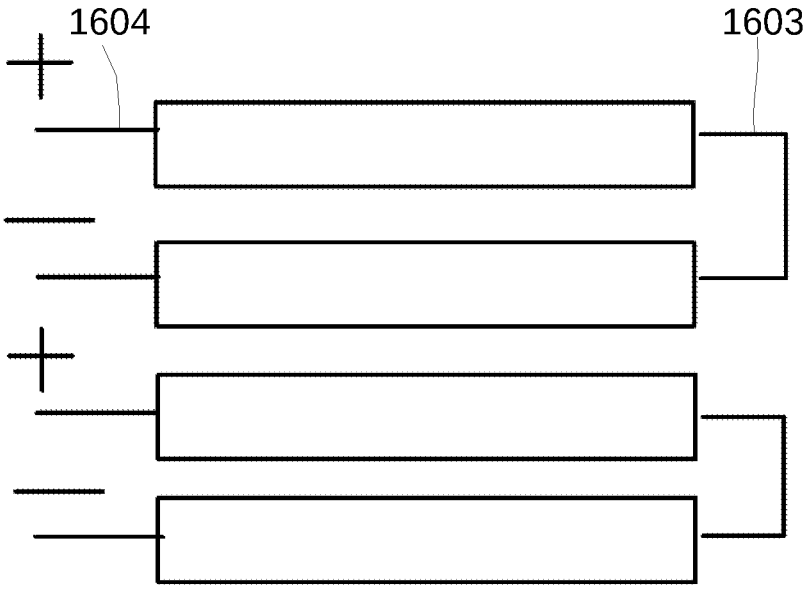
FIG. 16B illustrates another series/parallel arrangement of filaments.

Please refer to FIG. 16A and FIG. 16B. As mentioned above, we can carry out a wire layout above the top spreading structure and the bottom spreading structure. These wires are not necessarily a fine line in the traditional sense, it may be a conductor of different shapes, and these wires are provided as the above-mentioned top spreading structure and bottom spreading structure with an insulating material.

In FIG. 16A, the four filaments connect to the top 1601 and the bottom 1602 in series. In FIG. 16B, the four filaments connect in series, then connecting in parallel at the top 1603 and the bottom 1604. The other parallel, series ways can be adjusted according to different lighting requirements.

Figure 17:
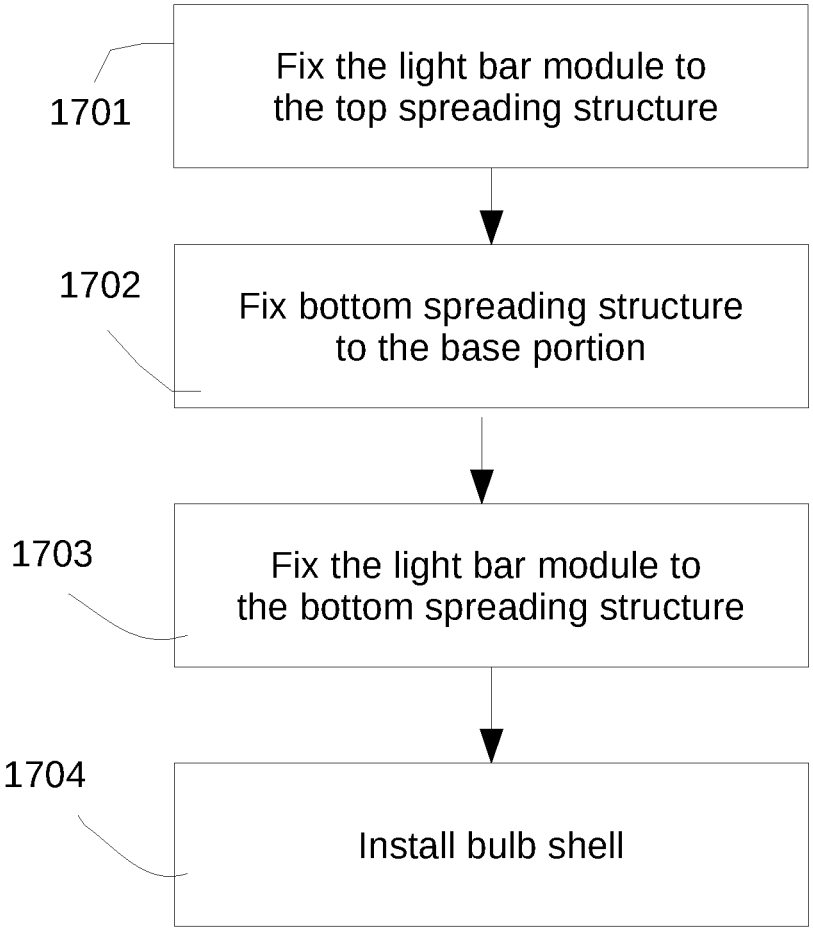
FIG. 17 illustrates a flow chart of a method of manufacturing a LED filament light.

Please refer to FIG. 17. FIG. 17 illustrates a flow chart of another embodiment according to the present invention. Providing a method for fabricating a LED filament light, including the following steps.

Fix the filament module to the top spreading structure (step 1701), the filament module is composed of a plurality of filaments, and each filament house a plurality of LED chips.

Fix the bottom spreading structure to the base portion (step 1702).

Fix the filament module to the bottom spreading structure (step 1703), the bottom of the plurality of filaments are fixed to the bottom spreading structure wherein the top spreading structure is only supported by the plurality of filaments.

Install the bulb shell (step 1704) to make the bulb shell connect to the base portion to form a containing space, and fill the thermal conductivity gas in the containing space from the air inlet of the base portion In this embodiment, the top spreading structure and the bottom spreading structure are provided with a top conductive element and a bottom conductive element respectively. The top conductive element and the bottom conductive element are used for electrically connecting to the plurality of filaments which is fixed to the top spreading structure and the bottom spreading structure.

In addition to the above-described embodiments, various modifications may be made, and as long as it is within the spirit of the same invention, the various designs that can be made by a person skilled in the art are susceptible to the present invention range.

The invention claimed is:

1. A LED filament light, comprising:

a bulb shell;

a base portion forming a containing space with the bulb shell, having a closed air inlet;

a thermal conductivity gas, entering the containing space from the air inlet and being maintained in the containing space after the air inlet being closed;

a filament module placed in the containing space, comprising a plurality of filaments, wherein there are electrical connectors at the top and the bottom of each filament, each filament containing a plurality of LED chips, a top of each filament being electrically connected to another top of at least another filament to form at least one set of filaments connected in series;

a top spreading structure, wherein the top of the plurality of filaments are fixed to the top spreading structure; and a bottom spreading structure fixed on the base portion, wherein the bottom of the plurality of filaments are fixed to the bottom spreading structure, wherein the top spreading structure is supported only by the plurality of filaments to maintain the position relative to the base portion.

2. The LED filament light of claim 1, wherein the top spreading structure is a polygonal structure or a ring structure, the top of the plurality of filaments are fixed to the sides of the top spreading structure.

3. The LED filament light of claim 1, wherein the top spreading structure is made of metal, the top of each filament electrically connected with the top spreading structure, respectively.

4. The LED filament light of claim 1, wherein the top spreading structure comprises a body, and a plurality of top extension pieces fixed on the body, the plurality of top extension pieces being made of conductive material, and electrically connected with the tops of a plurality of the filaments, the body and the top extension pieces being different elements.

5. The LED filament light of claim 4, wherein the top extension piece has a folded portion, the top electrical connector of the filament being welded to the folded portion of the extension piece.

6. The LED filament light of claim 1, wherein the top spreading structure at least provides with one top conductive element, the top conductive element electrically connecting all electrical connectors which are connected to the top of the filaments of the top spreading structure.

7. The LED filament light of claim 6, wherein the top spreading structure provides with two or more separate top conductive elements, the plurality of filaments being divided into two or more groups, and the top electrical connectors in the same group electrically connected through the top conductive elements, the top electrical connectors in different groups being electrically connected indirectly.

8. The LED filament light of claim 1, wherein the bottom spreading structure at least provides with two top conductive elements, the bottom conductive elements electrically connecting all electrical connectors which are connected to the top of the filaments of the bottom spreading structure.

9. The LED filament light of claim 1, wherein the bottom spreading structure provides with two or more separate bottom conductive elements, the plurality of filaments being divided into two or more groups, and the bottom electrical connectors in the same group electrically connected through the bottom conductive elements, the bottom electrical connectors in different groups being electrically connected indirectly.

10. The LED filament light of claim 9, wherein the base portion provides with two first assembly structures, the first assembly structure being a wire structure, one end of the first assembly structure electrically connected to a power supply element provided outside the base portion, and the other end of the first assembly structure protruded over the base portion after through the base portion, the two bottom conductive elements welded to the other end of the two first assembly structures, respectively, to secure to the base portion.

11. The LED filament light of claim 10, wherein the bottom conductive element is a rigid closed loop structure, the bottom conductive element having a greater cross-sectional area than the first assembly structure.

12. The LED filament light of claim 1, wherein the horizontal area of the top spreading structure is less than the horizontal area of the bottom spreading structure so that the plurality of filaments are arranged in a cone shape with wide bottom and narrow top, wherein the top spreading structure and the bottom spreading structure are shifted in a relative angle, so that the plurality of the filaments is distributed in twisted and interlocked.

* * * * *